US006206496B1

(12) United States Patent
Ushioda

(10) Patent No.: US 6,206,496 B1
(45) Date of Patent: Mar. 27, 2001

(54) INK JET RECORDING HEAD DRIVE DEVICE AND METHOD THEREOF

(75) Inventor: Toyoji Ushioda, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/199,279

(22) Filed: Nov. 25, 1998

(30) Foreign Application Priority Data

Nov. 27, 1997 (JP) ..... 9-326582

(51) Int. Cl.[7] ..... B41J 29/38; B41J 2/045
(52) U.S. Cl. ..... 347/10; 347/68
(58) Field of Search ..... 347/68–71, 9–11, 347/14, 39, 27

(56) References Cited

U.S. PATENT DOCUMENTS

| | | | | |
|---|---|---|---|---|
| 4,106,032 | | 8/1978 | Miura et al. | 346/140 R |
| 5,764,247 | * | 6/1998 | Asai | 347/10 |
| 5,894,242 | * | 4/1999 | Fujimoto | 347/407 |
| 5,894,316 | * | 4/1999 | Sakai et al. | 347/54 |

FOREIGN PATENT DOCUMENTS

| | | |
|---|---|---|
| 51-37541 | 3/1976 | (JP) . |
| 61-100469 | 5/1986 | (JP) . |
| 62-174163 | 7/1987 | (JP) . |
| 7-266580 | 10/1995 | (JP) . |

* cited by examiner

*Primary Examiner*—John Barlow
*Assistant Examiner*—Raquel Yvette Gordon
(74) *Attorney, Agent, or Firm*—Foley & Lardner

(57) ABSTRACT

An ink jet recording head according to the present invention ejects an ink droplet from a nozzle by applying a drive voltage to an electro-mechanical transducer located at the position corresponding to a pressure generation chamber, and deforming the electro-mechanical transducer. In the voltage wave form of the drive voltage that the ink jet recording head applies to the electro-mechanical transducer during a recording time, the rise time up to the peak voltage, and the fall time down to the basic voltage are both equal to approximately a half of the natural period To of the acoustic oscillation of the ink in an ink-flow course system, whereas the time Tw from the beginning of rising to the beginning of falling is equal to integer-times the natural period To including one.

18 Claims, 11 Drawing Sheets

INK JET RECORDING HEAD DRIVE DEVICE AND METHOD THEREOF

BACKGROUND OF THE INVENTION

1. Field of the Invention

The present invention relates to an ink jet recording head drive apparatus and method thereof, which controls the diameter of an ink droplet to be ejected.

2. Description of the Related Art

In general, a recording head comprises a piezo-electric actuator to eject a liquid droplet for recording as necessary. Drop-on-demand-type ink jet recording heads are well-known, where a pressurized wave is generated in an ink chamber of the recording head by giving the piezo-electric actuator an electric signal, and with the help of the pressurized wave, a liquid droplet is ejected from a nozzle. Of these types of recording heads, an ink jet recording head is proposed (see Japanese Patent Application Laid-open No. Sho-51-37541, for example) where the diameter of a dot is changed in order to display a gradation image such as a picture image, enabling a gradation recording. FIG. 15 shows the ink jet recording head.

In FIG. 15, 181 denotes an ink jet recording head, 182 denotes a pressure chamber, and 183 denotes an ink supply layer. 184 denotes a first nozzle to connect pressure chamber 182 to the ink supply layer 183, 1000 denotes a diaphragm, 185 denotes a piezo-electric device, and 186 denotes a second nozzle.

When some pressure signal is applied on the piezo-electric device 185, a vibration is given to the pressure chamber 182 via the diaphragm 1000. The vibration causes generation of a pressurized wave in the ink in pressure chamber 182. The pressurized wave is then propagated to the first nozzle 184. The ink in the ink supply layer 183 receives the pressurized wave being ejected as an ink droplet 188 from a second nozzle 186.

When a gradation image is recorded using the ink jet recording head 181 operated in conformity with the above principle, the number of gradation levels L is represented by the following equation:

$$L=N^2 \tag{a}$$

where we assume that a single pixel is made up of a matrix of N×N dots 151 as shown in FIG. 17A, and therein the gradation is expressed by the arrangement of the dots 151 in the matrix. However, for an image which requires a high resolution and high gradation, such as that of a picture image, the size of the matrix N has to be larger, as is apparent from the above equation. Accordingly, the image configured with such pixels seems short in the resolution per a single pixel, and quite high dot-resolution is needed. Contrary to this, if the dot diameter is changed, each dot itself is allowed to have separate gradation levels. Thus, the number of gradation levels L is expressed by the following equation:

$$L=n\times N^2 \tag{b}$$

where, n denotes the number of gradation levels per single dot. For the example, n=1, and N=3, shown in FIG. 17A, the number of gradation levels L is equal to 9, which is calculated using the equation (b). In contrast, as shown in FIG. 17B, if the dot diameter can change into one of four separate levels 151*a* to 151*d* the number of gradation levels L is thirty six due to the fact than n=4 and N=3 and the image configured with such pixels seems sufficient resolution per single pixel. Thereby, according to the above approach, without improving the dot resolution, the number of gradation levels can be increased. In this case where the dot diameter is controlled to vary, the volume Q of a ejected ink droplet is represented by the following relational expression:

$$Q\ \tau\times v\times A \tag{c}$$

Where, τ denotes the wave cycle of a pressurized wave generated in the pressure chamber 8, v denotes the ink droplet ejection speed, and A denotes the cross sectional area of a second nozzle 186. The ink droplet ejection speed, v has a relation as shown in the following expression:

$$v\ V \tag{d}$$

Where, V denotes a voltage applied to the piezo-electric device 185.

According to the above expression, the peaks Pa to Pd of the pressure applied to the ink in the pressure chamber 182 differ dependent upon the increase/decrease of the applied voltage V, as shown in the pressure response chart of FIG. 16. The changes in the peak pressure Pa to Pd cause the change in the ink droplet ejection speed, v. However, due to the fact that the cycle τ of the pressurized wave does not change, the expression (c) only needs the parameter, the applied voltage V. therefore, the relation is represented by the following expression:

$$Q\ V \tag{e}$$

In the conventional ink jet recording head, the relational expression is used to increase or decrease the volume of ink droplet 188 (Q) to be ejected from the second nozzle 186 by increasing or decreasing the applied voltage V to be applied to the piezo-electric device 185, and controlling the pressure P of the ink in the pressure chamber 182. However, in the approach where the ink droplet ejection speed, v is changed by the increase or the decrease of the applied voltage V, the flight speed of an ink droplet, to the relative speed of the head to the recording paper changes. Accordingly, the location on a recording paper where an ink droplet falls is slipped. This location slip degrades the recording quality. For example, ejection of a minute ink droplet may cause ink to easily fall around the second nozzle 186 due to the fact that the flight speed of the ink droplet is low.

In order to solve the above problems, as is shown in FIG. 15, in conventional approach, air-flow course 189 is added along the outside of the head. Therein, an air flow 191 is generated and flows out from a third nozzle 190 prepared in front of the second nozzle 186 at a constant speed, with the help of an air pump or an accumulator (not shown in the figure) prepared externally. The ink droplet 188 to be ejected from the second nozzle 186 is then carried along with the air flow 191. This configuration enables the successful control of increasing or decreasing the speed so that the speed can be equal to that of the air flow 191. However, this approach requires the attachment of the air pump or the accumulator, as a means to generate the air flow 191, to the head. Accordingly, preparation of an air-flow course is required in the body of the head. This creates a demand for a bigger, heavier, and more complex head.

The ink jet recording head, disclosed in Japanese Patent Application Laid-open No. Sho-61-100469, has been proposed as a means to solve the above problems. According to the proposal, while directing the attention to the above expression (c), the wave cycle τ of an ink pressurized wave is changed, and therefore the volume of the ink droplet to be ejected, Q is increased or decreased with the ink droplet ejection speed, v being constant. Specifically, several separate ink-flow courses with respective natural periods are installed so that pressurized waves with respective separate cycles $\tau$ are generated, and thereby that independent diameters of ink droplets are ejected from respective nozzles. However, there is a problem in having several ink-flow courses as a larger size of head which is high in cost is required.

In addition to that, as shown in FIG. 18, a wave with the wave forms in several natural oscillation modes is generated in the ink-flow course. A drop-on-demand-type ink jet recording head, disclosed in Japanese Patent Application Laid-open No. Sho-62-174163, for example, has been proposed in order to generate a specific oscillation mode. Wherein, with a piezo-electric device being attached on a single location or each of several locations of the loops in the amplitude of a wave form in the specific oscillation mode, the piezo-electric devices are driven.

As shown in FIG. 18(*a*), the part enclosed by a broken line shown in an ink-flow course 171 indicates the location of a piezo-electric device 172. As is shown in FIG. 18(*b*), the length of the piezo-electric device 172 is between the first node 176 and the second node 177 in the third-order natural oscillation mode 74 of the ink in the ink-flow course 171, whereas the location of the piezo-electric device attached, is the same as that of a loop 175 between the nodes. When a voltage wave, the wave form which fits the third-order natural period, for example, is applied to the piezo-electric device 172, a pressurized wave of comparatively short wave length in the third mode is generated in the ink in the ink-flow course 171. The pressurized wave generated causes for ejection with a comparatively small diameter of ink droplet. In order to generate a wave in high-order mode, for example fourth-order or fifth-order mode, it is recommended that a piezo-electric device is attached on the part corresponding to the loop in the oscillation mode, and that voltage is applied, the voltage form of which corresponds to the natural period.

However, in the conventional configurations, it is difficult to generate an oscillation mode other than both the basically natural oscillation mode (the first-order mode) and another higher oscillation mode. Therefore, a problem will occur where only two types of ink droplets in the basically natural oscillation mode and another higher oscillation mode, respectively, are obtained. Accordingly, it is difficult to obtain many independent dot-diameters, and to form an image with multi-gradation levels such as a picture image.

SUMMARY OF THE INVENTION

Accordingly, the objective of the present invention is to provide an ink jet recording head drive apparatus and drive method thereof, in which the ink jet recording head is configured very simply, and in which independent diameters of ink droplets are ejected from the same nozzle in order to record in a state which is always stable, at a constant speed, by driving the head under optimized drive conditions.

According to an aspect of the present invention, an ink jet recording head drive apparatus is provided, which includes: a nozzle; a pressure generation chamber connected to the nozzle; an electro-mechanical transducer located at the position corresponding to the pressure generation chamber; and at least one ink-flow course system connected to an ink pool, and which comprises a drive circuit to output a drive voltage formed in accordance with the natural period of the acoustic oscillation of ink in the ink-flow course system, wherein the electro-mechanical transducer is deformed by applying the drive voltage output from the drive circuit to the electro-mechanical transducer during a recording time so that the nozzle ejects an ink droplet.

According to an aspect of the present invention, the drive circuit forms a voltage wave form in which the rise time ranging from the basic value up to the peak value, and the fall time from the peak value down to the basic value are both equal to approximately a half of the natural period of the basic natural oscillation mode in the acoustic oscillation of the ink in the ink-flow course system, whereas the time ranging from the beginning of the rise time to the beginning of the fall time is equal to integer-times including one-times the natural period.

With the help of the drive circuit, even though the electro-mechanical transducer is prepared along all ink-flow courses, the voltage is applied, where the rise time and the fall time in the wave form of the voltage are both equal to approximately a half of the natural period of the basic natural oscillation mode in the acoustic oscillation of the ink in the ink-flow course system. Therefore an excitation of the basic natural oscillation mode is made irrelevant of the length of the electro-mechanical transducer, and a basic pressurized wave is generated in the ink-flow sources.

Furthermore, since the time ranging from the beginning of the rise time in the voltage wave form to the beginning of the fall time is equal to integer-times including one-times the natural period of the basic natural oscillation mode in the acoustic oscillation of the ink in the ink-flow course system, a positive impulse is applied to the ink at the point of ascending in the voltage wave form, whereas a positive impulse is applied to the ink at the point of descending in the voltage wave form. Thus, the application of the positive impulse to the ink causes generation of a periodic pressurized wave. At the end of the first period of the pressurized wave, in other words, at the point when the second pressurized positive wave is generated, a negative impulse is applied, causing suppression of both the pressurized waves. Therefore, the residual oscillation in the ink-flow course system is attenuated, allowing for stable eject of an ink droplet.

According to an aspect of the present invention, the drive circuit, comprising: a triangular-shaped first voltage wave form, in which the rise time ranging from the basic value of the voltage wave form up to the peak value, and the fall time ranging from the peak value down to the basic value are both equal to approximately a half of the natural period of a higher-order natural oscillation mode than the basic natural oscillation mode in the acoustic oscillator of the ink in the ink-flow course system; and a second voltage wave form with the same shape as the first voltage wave form, forms a voltage wave form, in which the time range ranging from the beginning of the rise time in the first voltage wave form to the beginning of the rise time in the second voltage wave form, is equal to a half of the natural period of the basic natural oscillation mode.

With the help of the above drive circuit, an optional selection and/or modification of a rise time and fall time in the voltage wave form allows for a phase change in the wave length of the pressurized wave, more specifically the size of an ink droplet, in keeping with the intensity of the pressure, namely the constant speed of ejecting the ink droplet. Moreover, since the phase difference between the beginning of the rise time in the first voltage wave form and the beginning of the rise time in the second voltage wave form is equal to a half of the natural period of the basic natural oscillation mode, a possible excitation of the basic natural oscillation mode is not made, and a possible residual oscillation caused by the natural oscillation mode selected is prevented.

According to an aspect of the present invention, the drive circuit, comprising: a first voltage wave form, in which the rise time ranging from the basic value up to the peak value, and the fall time from the peak value down to the basic value are both equal to approximately a half of the natural period of a higher-order natural oscillation mode than the basic natural oscillation mode in the acoustic oscillation of ink in the ink-flow course system; and a second voltage wave form with the same shape as the first voltage wave form, forms a voltage wave form, in which the time range from the beginning of the rise time in the first voltage wave form to the beginning of the rise time in the second voltage wave form, is equal to a half of the natural period of the basic natural oscillation mode.

With the help of the drive circuit, an optional change in the voltage hold time corresponding to the difference between the rise time and fall time in the voltage wave form, allows for a phased change in the wave length of the pressurized wave, more specifically the size of an ink droplet, in keeping with the intensity of the pressure, namely the constant speed of ejecting the ink droplet. Moreover, since the phase difference between the beginning of the rise time in the first voltage wave form and the beginning of the rise time in the second voltage wave form is equal to a half of the natural period of the basic natural oscillation mode, a possible excitation of the basic natural oscillation mode is not made, and a possible residual oscillation caused by the natural oscillation mode selected is prevented.

According to an aspect of the present invention, the drive circuit for forming a first and second voltage wave form, in which the rise time ranging from the basic value up to the peak value, and the fall time ranging from the peak value down to the basic value are both equal to approximately a half of the natural period of a higher-order natural oscillation mode than the basic natural oscillation mode in the acoustic oscillation of an ink in the ink-flow course system, forms a voltage wave form, where the voltage descends once, after which the voltage ascends in accordance with the first and second voltage forms.

With the help of the drive circuit, the speed of ejecting an ink droplet will be improved, without application of a high impulse to the electro-mechanical transducer, which may cause for loss of the polarization of the electro-mechanical transducer.

BRIEF DESCRIPTION OF DRAWINGS

Other features and advantages of the invention will be made more apparent by the detailed description that follows, taken in conjunction with the accompanying drawings, wherein.

DETAILED DESCRIPTION OF THE PREFERRED EMBODIMENTS

An embodiment of the present invention will be described hereafter with reference to the drawings.

Figure 1:
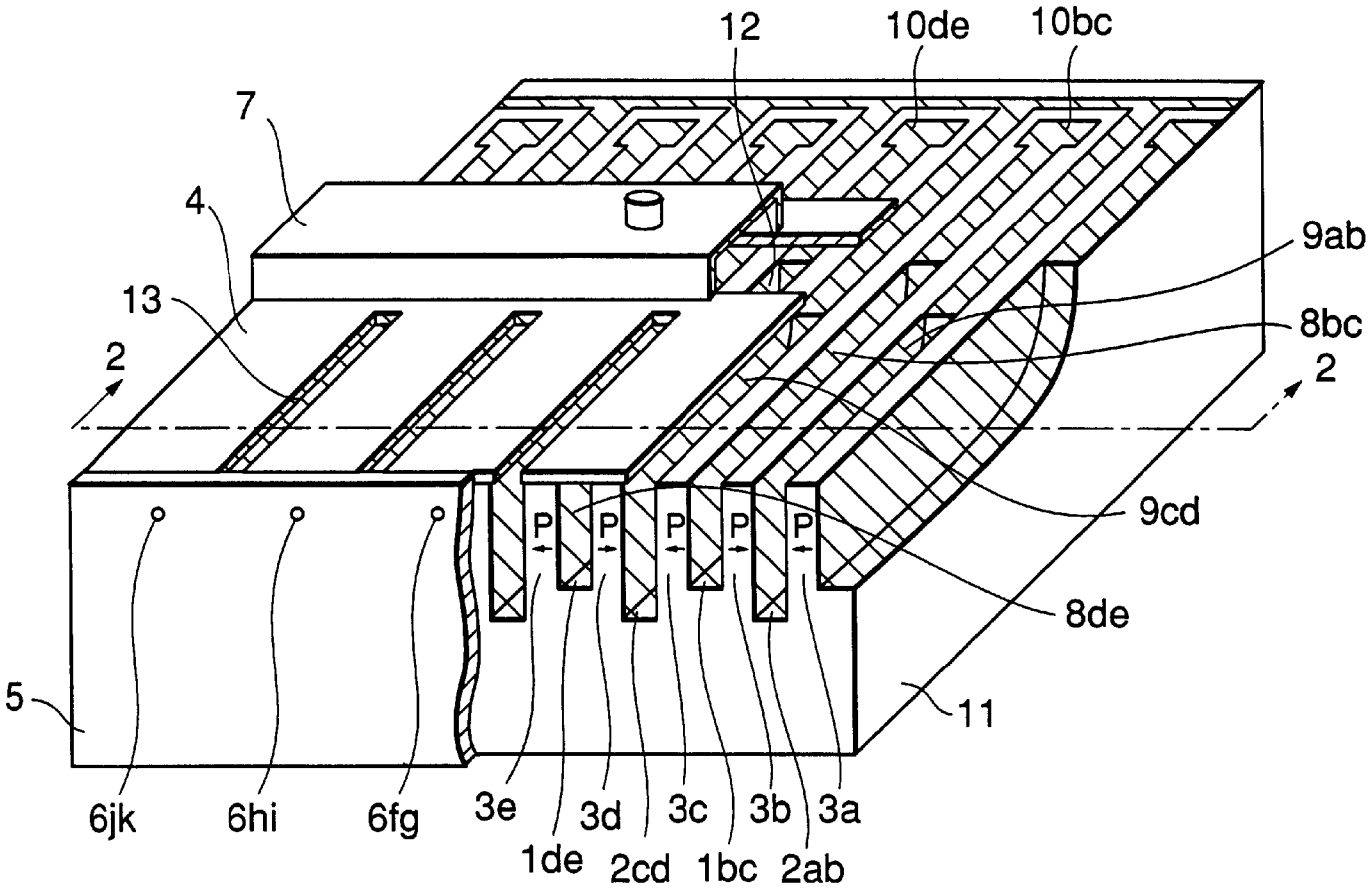
FIG. 1 shows the outward appearance of an ink jet recording head according to an embodiment of the present invention.

In FIG. 1, reference numeral 11 denotes a piezo-electric device which makes up an electro-mechanical transducer. In the piezo-electric device 11, ink-flow courses 1*bc*, 1*de*, . . . , etc. and dummy-flow courses 2*ab*, 2*cd*, . . . , etc. are alternately formed in almost a parallel manner. Both sides of these courses are enclosed by side walls 3*a*, 3*b*, 3*c*, 3*d*, 3*e*, . . . , etc. whereas their upper sides and front sides are enclosed by a top plate 4, and a nozzle plate 5, respectively. In the rear of the ink-flow courses 1*bc*, 1*de*, . . . , etc., an ink pool 7 is connected via an ink supply hole 12.

Nozzles 6*dc*, 6*de*, 6*fg*, . . . , etc. (6*bc* and 6*de* are both shown in the figure), connected to respective ink-flow courses 1*bc*, 1*de*, . . . , etc. are attached on the nozzle plate 6.

Independent electrodes 8*bc*, 8*de*, . . . , etc. are formed on the side surfaces and underside surfaces of the ink-flow courses 1*bc*, 1*de*, . . . , etc. made of the piezo-electric device 11. Common electrodes 9*ab*, 9*cd*, . . . , etc. are formed on the side surfaces and underside surfaces of the dummy-flow courses 2*ab*, 2*cd*, . . . , etc. made of the piezo-electric device 11. Independent electrodes 8*bc*, 8*de*, . . . , etc. are formed in the ink-flow courses 1*bc*, 1*de*, . . . , etc., respectively, and also electrically connected to pads 10*bc*, 10*de*, . . . , etc. formed on the upper surface of the piezo-electric device 11. The common electrodes 9*ab*, 9*cd*, . . . , etc. are formed within the dummy-flow courses 2*ab*, 2*cd*, . . . , etc., respectively, and also electrically connected to a common pad (not shown in the figure). Ink (not shown in the figure) is filled in all of the ink-flow courses 1*bc*, 1*de*, . . . , etc., the nozzles 6*bc*, 6*de*, . . . , etc., and the ink pool 7 so that the configuration where the ink is not directly contacted with the above electrodes is made. The side walls 3*a*, 3*b*, 3*c*, 3*d*, 3*e*, . . . , etc. have been subjected to a polarization process in their width directions (namely, in the direction of arrows P). The top plate 4 is flexible, with a plurality of slits 18 located on the respective dummy-flow courses 2*ab*, 2*cd*, . . . , etc.

Next, the operation of ejecting ink by the head will be explained hereafter.

At first, while referring to FIGS. 2A to 2D, the following case will be explained: where the ink-flow course 1*bc* of the plurality of ink-flow courses 1*bc*, 1*de*, . . . , etc. is driven, and thereby an ink droplet is ejected from the nozzle 6*bc* (not shown in the figure) connected to the course.

It is noted that we define "the ink-flow course is driven" to mean that both sides of the side walls 3*b* and 3*c*, which make up the ink-flow course, are driven.

Figure 2A:
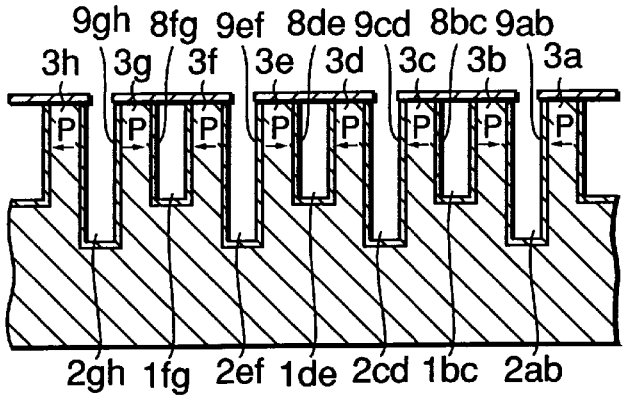
FIGS. 2A to 2D show the cross section, in terms of a cutting line 2—2, of the ink jet recording head in FIG. 1.

As shown in FIG. 2A, the polarization directions of the side walls 3*b* and 3*c* of the piezo-electric device enclosing the ink-flow course 1*bc* are the same as the directions from the ink-flow course 1*bc* to the dummy-flow courses 2*ab* and also to 2*cd* (shown with arrows P). It is noted that FIG. 2A shows the state where a voltage is not applied to the electrode 8*bc* so that an electric field is not generated on the side walls 3*b* and 3*c* of the piezo-electric device 11.

Figure 2B:
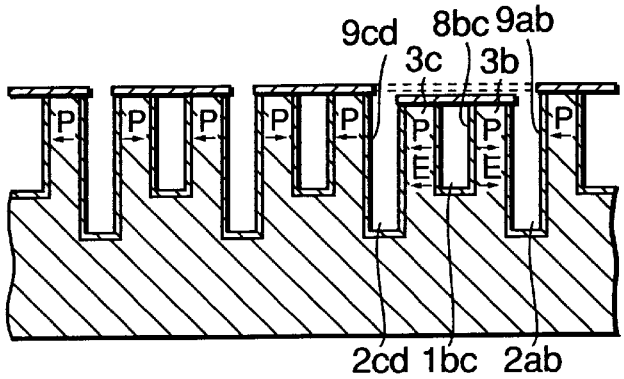

As shown in FIG. 2B, when a voltage is applied to the electrode 8*bc* to generate electric fields along the respective side walls 3*b* and 3*c* of the piezo-electric device 11 enclosing the ink-flow course 1*bc* in the direction of an arrow E, the polarization direction (shown by the arrows P) is the same as that of the electric fields (shown by an arrow E). Therefore, the side walls 3*b* and 3*c* extend in the directions of the electric fields. In this case, conversely, they contract in the perpendicular direction to the electric fields.

As a result, the capacity of the ink-flow course 1*bc* decreases sharply, causing generation of a pressurized wave. The pressurized wave generated is propagated to the nozzle 6*bc*, and the ink deposited in the nozzle 6*bc* is ejected.

Figure 2C:
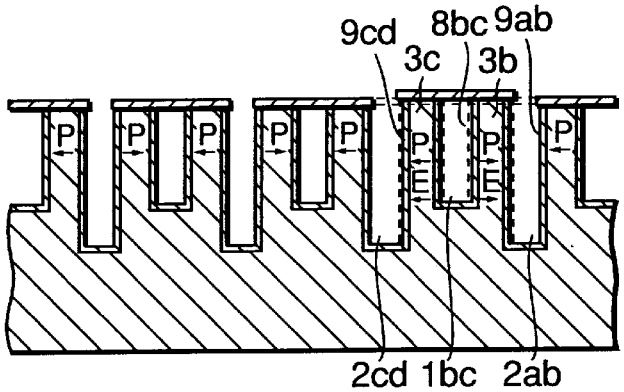

Thereafter, as shown in FIG. 2C, when a voltage is applied to the electrode 8*bc* so that electric fields are generated along the side walls 3*b* and 3*c* in the directions indicated by the arrows E, the polarization directions (namely, the directions indicated by the arrows P) are different from those of the electric fields (namely, directions indicated by the arrows E). Therefore, the side walls 3*b* and 3*c* contract in the directions of the electric fields, whereas they extend in the perpendicular directions of the electric fields. As a result, the capacity of the ink-flow course 1*bc* increases and conversely the pressure decreases, causing a cut of the ink-flow to be ejected from the nozzle 6*bc* into an ink droplet, which then flows out. It is noted that, it is also possible that the state shown in FIG. 2A goes directly into the state shown in FIG. 2C, alternatively, where the meniscus of the ink deposited in the nozzle 6*bc* is retreated once, and then going into the state shown in FIG. 2C where an ink droplet is ejected. Furthermore, even though the process shown in FIG. 2C is omitted, the ink deposited in the nozzle 6*bc* continues to move forward with the help of a momentum of inertia, and the ink flow is soon after cut so that an ink droplet is generated and ejected.

Figure 2D:
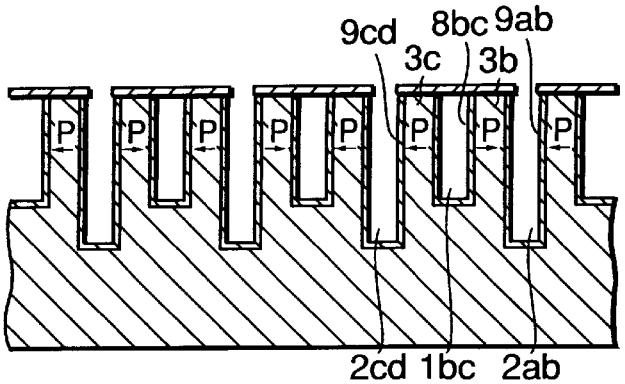

Next, when zero voltage is applied to the side walls 3*b* and 3*c*, namely when the electric field becomes zero, the side walls 3*b* and 3*c* return to their former states, as is shown in FIG. 2D. However, the amount of ink in the ink-flow course 1*bc* is decreased by the amount of ejected ink droplets, and the ink pressure decreases. Due to the decrease in the pressure of the ink, ink is supplied from the ink pool 7 with the help of the pressure caused by the surface tension of the meniscus of the ink deposited in the nozzle 6*bc*, namely by capillary action.

In the embodiment, when voltages are applied to the electrodes 8*bc* and 8*de* of the piezo-electric device 11 in order to generate a pressurized wave, and the forms of the applied voltages are changed, the wave length of a pressurized wave is controlled, ejecting a desired diameter of ink droplet.

Since the ink-flow course 1*bc* can be seen as an acoustic pipe with ink as a medium, there exists an infinite number of modes of wave lengths, each being equal to the value of one by an integral number of the longest wave length of the basic mode, in terms of the number of natural oscillation modes in the acoustic oscillation (longitudinal wave) of the ink in the ink-flow course 1*bc*.

In the general ink jet recording head, the wave length of a pressurized wave propagated to the nozzle 6 is determined by the natural oscillation mode dependent upon the ink. The wave length determined determines the volume of an ink droplet. The cycle of the pressurized wave in the natural oscillation mode decreases into a half, one third, . . . , etc. while increasing the order in such a manner as the second-order natural period, the third-order natural period, . . . , etc., where we define the cycle of the basic mode (the first-order natural period) to be 1. Therefore, when the ink in the ink-flow course 1 is excited with an optional natural oscillation mode, a pressurized wave with its wave length being equal to the natural period is generated, and a given volume of ink droplet is ejected in accordance with the wave length.

Defining the volume of the ink droplet in the basic mode to be 1, the volume of an ink droplet in the third-order mode is a third, in other words, approximately 30% decrease in diameter. It is noted that as to the actual shape of the ink-flow course 1, since the cross section's shapes of the nozzle and the ink-flow course change, in general, the natural periods of respective oscillation modes are not necessary to be exact values, which is equal to the value of one by an integral number of the basic mode's cycle.

To make an excitation of a specific natural oscillation mode, it is recommended that the necessary hold time of the impulse imposed on the ink be set to at least a half of the natural period of the natural oscillation mode. The amplitude of the impulse is proportional to the deformation speed of the side walls 3*b* and 3*c* of the piezo-electric device 11 facing the ink. Specifically, the change in the impulse imposed on the ink is relatively equal to the result of differentiating the voltage wave form shown in (a) of FIG. 8, and the amplitude of the impulse is proportional to the inclinations of respective leading and trailing edges 22 and 23, namely, the deformation speeds of the side walls 8*b* and 3*c*. In addition to that, the hold time of the impulse is equal to the rise time 26 from the basic value to the peak value in voltage, and also equal to the fall time 27 from the peak value to the basic value in voltage. The impulse 24 corresponding to the leading edge 22 is positive, whereas the impulse 25 corresponding to the trailing edge 23 is negative.

The phase difference between impulses 24 and 25 correspond to the time difference between the beginnings of the leading edge 22 and falling edge 23, namely, a pulse width Tw.

Figure 4:
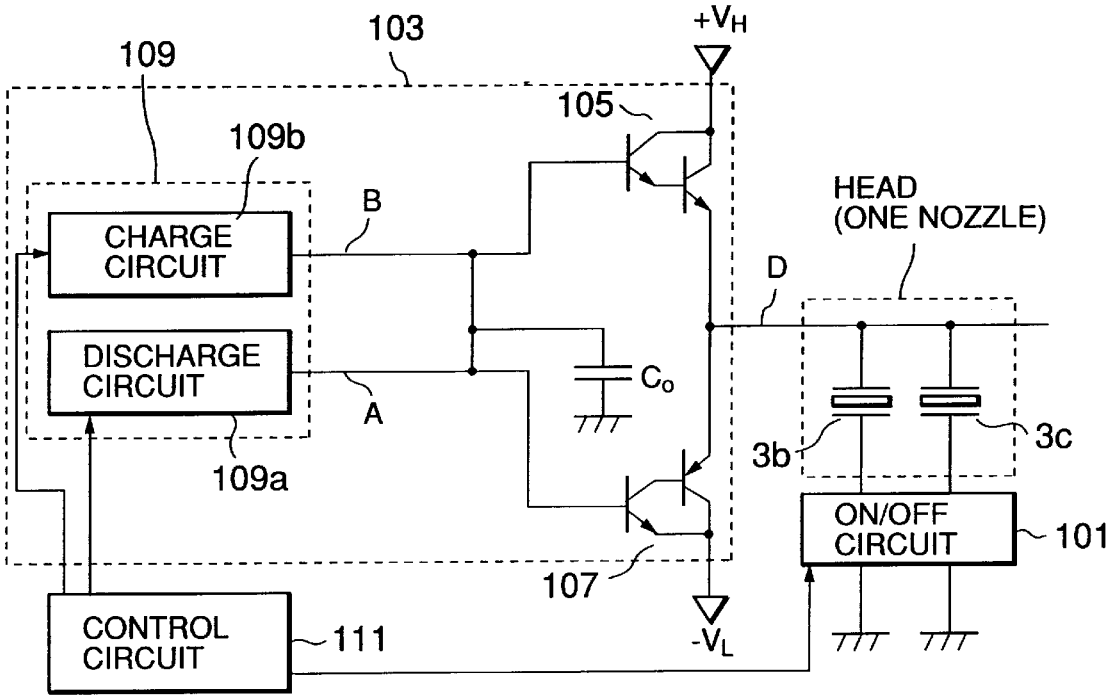
FIG. 4 is a circuit diagram of a drive circuit to drive a piezo-electric device.

In the embodiment, a drive circuit shown in FIG. 4 is used to change the wave form of an applied voltage so that the wave length of a pressurized wave is controlled and that the diameter of the ink droplet to be ejected is determined. It is noted that the figure shows only side walls 3*b* and 3*c*, and the other side walls are omitted from being shown in the figure.

An ON/OFF circuit 101 is connected to the side walls 3*b* and 3*c*. The ON/OFF circuit 101 connects the side walls 3*b* and 3*c* to a ground only when it is activated. A drive circuit 103 is connected to the side walls 3*b* and 3*c*, via a control line D. The drive circuit 103 comprises a first group of transistors 105, a second group of transistors 107, and a wave form shaping circuit 109. Wherein, the wave form shaping circuit 109 comprises a discharge circuit 109*a* and charge circuit 109*b*. 111 denotes a control circuit to output a pulse output command to the discharge circuit 109*a* and the charge circuit 109*b*, at given times.

Figure 5:
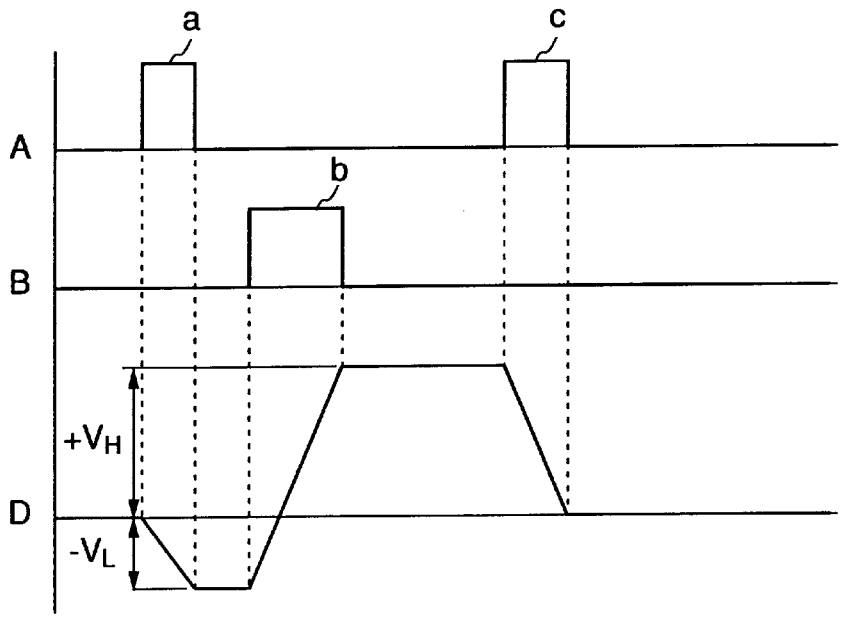
FIG. 5 is a diagram showing the wave form of the drive voltage.

When recorded dot data is latched by the ON/OFF circuit 101 via the control circuit 111, a descending command pulse a with a given time width shown in FIG. 5 is transmitted from the discharge circuit 109*a* to the second group of transistors 107 via a control line A, and the side walls 3*b* and 3*c* are electrically driven by a voltage $-V_L$, via both the second group of transistors 107 and a control line D, as shown in FIG. 4.

In this case, the voltage applied to the side walls 3*b* and 3*c* falls until $-V_L$ during the fall time of the pulse a, as shown in FIG. 5.

Next, as shown in FIG. 4, when an ascending command pulse b is sent from the charge circuit 109*b* to the first group of transistors 195, via a control line B, in a given period of time, the voltage along the control line D is stepped up to +VH. In this case, the voltage applied to the side walls 3*b* and 3*c* is raised up to +Vh in the rise time of the width of the pulse b, as shown in FIG. 5, causing deformation of the side walls 3*b* and 3*c* to the inside (see FIG. 2B, for example). As a result, a corresponding impulse is applied to the ink in the ink-flow course.

Moreover, in a given period of time, when a descending command pulse c is sent from the discharge circuit 109*a* to the second group of transistors 107 via the control line A, again, the drive voltage is returned to +0 volts, as shown in FIG. 5.

Figure 3:
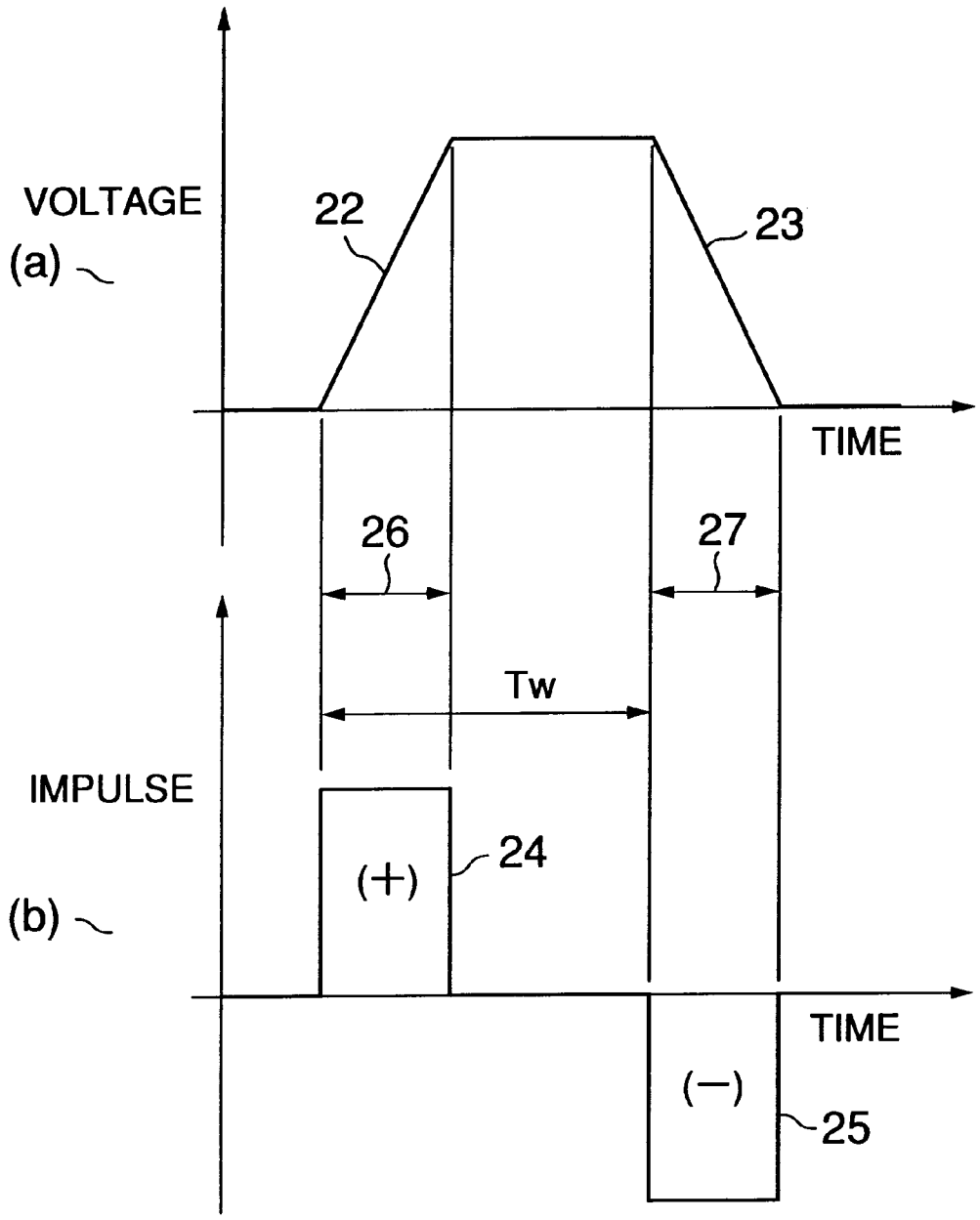
FIG. 3 shows a typical form of voltage to be applied to a piezo-electric device (a) and the form of impulse (b), applied to the ink in an ink jet recording head, caused by the voltage shown in (a).

In the embodiment, since the raise commanding pulse b, and the descending commanding pulses a and c are each output at given times via the discharge circuit 109*a* and the charge circuit 109*b*, a drive pulse wave form with optional fall/rise times is generated. For example, when a trapezoid-shaped wave form as shown in (a) of FIG. 3 is generated, the voltage $-V_L$ shown in FIG. 4 is set to the zero volt.

First Embodiment

Figure 6:
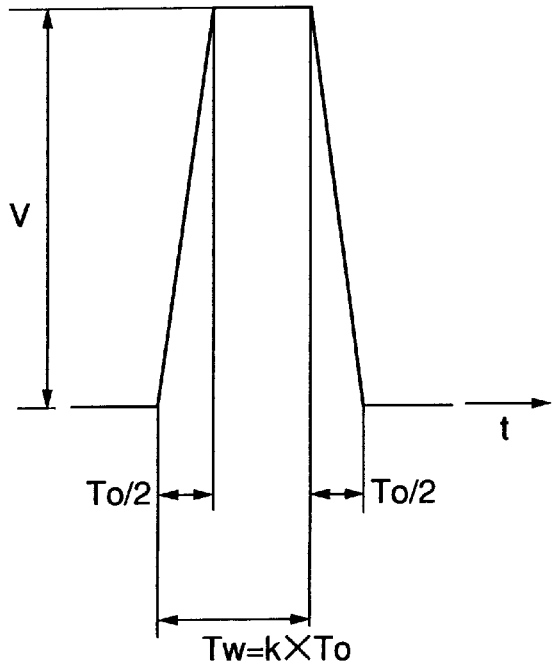
FIG. 6 is a diagram showing an optimized, basic voltage wave form.

When the excitation of the basic natural oscillation mode with the natural period being To is made, as shown in FIG. 6, application of the drive voltage with both the rise time from the basic voltage value to the peak value V (hereafter, referred to as just "rise time") and the fall time from the voltage peak value V to the basic value (hereafter, referred to as just "fall time") being equal to To/2, causes an excitation of a pressurized wave with the natural period To, which is made efficiently corresponding to the voltage wave form.

The impulse applied to the ink is proportional to the rise gradient of the wave form. When the rise gradient is constant, the pressure response of the ink to the impulse hold time (rise time) approaches the peak in a half of the natural period. In other words, when the rise time is equal to the half of the natural period or more, the pressure response of ink reaches its peak. Therefore, even though the rise time and fall time are both equal to To/2 or more, the ink pressure does not exceed the peak value.

Figure 7:
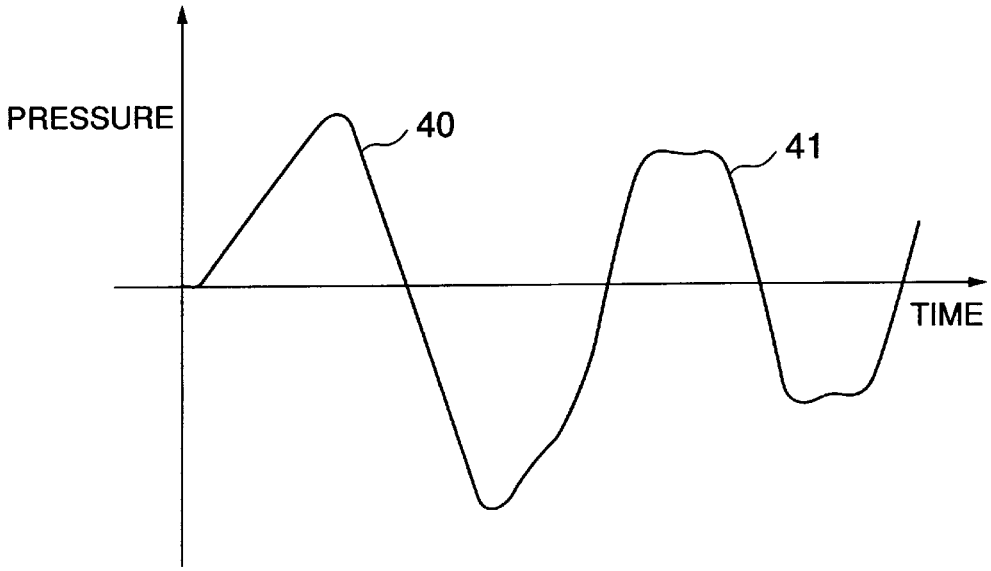
FIGS. 7 is a graph showing a pressure response when an unoptimized form of voltage is applied.

On the other hand, even though excitation of the pressure wave with the natural period described above is made efficiently, after the first wave 40 has been generated to eject an ink droplet, as shown in the transient response graph of FIG. 7 regarding the ink pressure in the ink-flow course, a residual oscillation 41 occurs at and after the second wave, which is dependent upon the pulse width Tw of the voltage wave form (ranging in time from the beginning of the rise of basic value of the voltage wave form to the beginning of the fall from the peak value V). Wherein, the residual oscillation 41 may cause generation of a satellite effect (excessive minute ink droplets flying following a main ink droplet), which may cause degradation of character printing quality.

In order to ensure high printing quality, the residual oscillation 41 should be controlled. In the embodiment, the residual oscillation 41 is controlled using the trapezoid-shaped wave form with the above pulse width Tw being equal to k-times the basic natural period To (k is an integer, e.g., k=3 in FIG. 6).

The operation will be explained more in detail hereafter. As is explained above, the amplitude of the impulse is proportional to each deformation speed of the side walls 3*b* and 3*c* facing the ink in the piezo-electric device 11. Accordingly, the deformation speed corresponds to the rise time and fall time of the voltage wave form. Therefore, a positive impulse is applied to the ink during the rise time of the voltage wave form, whereas a negative impulse is applied to the ink during the fall time.

By using the trapezoid-shaped wave form as shown in FIG. 6, a positive impulse is applied to the ink so that a pressure wave with a cycle is generated. When the next positive pressure wave is generated, a negative impulse is applied. Therefore, the generated pressure waves cancel each other out to zero, causing control of the residual oscillation 41.

Second Embodiment

To generate a minute ink droplet, it is recommended to make an excitation of a higher order natural oscillation mode than the basic natural oscillation mode (the first-order mode), for example the second-order mode or the third-order mode. As described above, by using a voltage wave form with the basic natural period To in the basic natural oscillation mode or the natural period Tn in the n-order mode (n is an integer equal to or more than two), a desired volume of an ink droplet will be ejected. However, in this approach, since excitation of the basic natural oscillation mode must be made, it is difficult to obtain a desired diameter of the ink droplet. In addition to that, since the basic natural oscillation mode is left as a residual oscillation, the quality of recording must be decreased.

In the second embodiment, to solve the above problems, excitation of a specific natural oscillation mode will be made by suppressing the basic natural oscillation mode generated earlier with the help of application of the second wave form of voltage.

Figure 8:
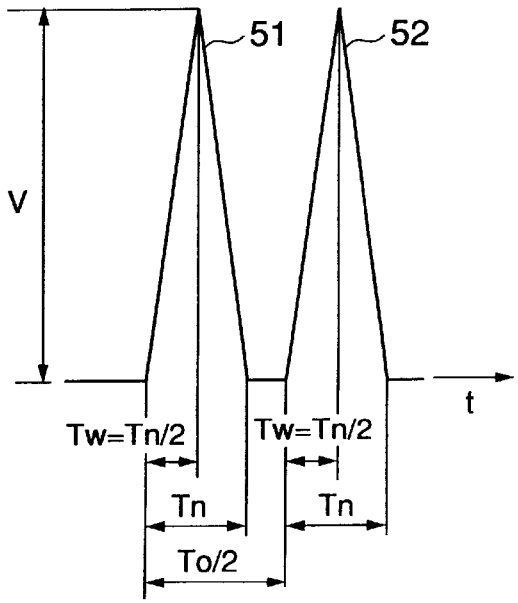
FIG. 8 shows a form of voltage applied to the ink jet recording head according to the embodiment of the present invention.

Specifically, as shown in FIG. 8, to control both the excitation of the basic natural oscillation mode, and the residual oscillation in the natural oscillation mode excited, a triangular-shape of a first voltage 51 with half the period of the specific natural oscillation mode (Tn/2) to be excited, as a rise time and fall time, is applied, after which application of the second voltage 52 in succession, the wave form of which is the same as that of the first voltage 51 with the phase shifted by a half of the basic natural period To in the basic natural oscillation mode.

Figure 9:
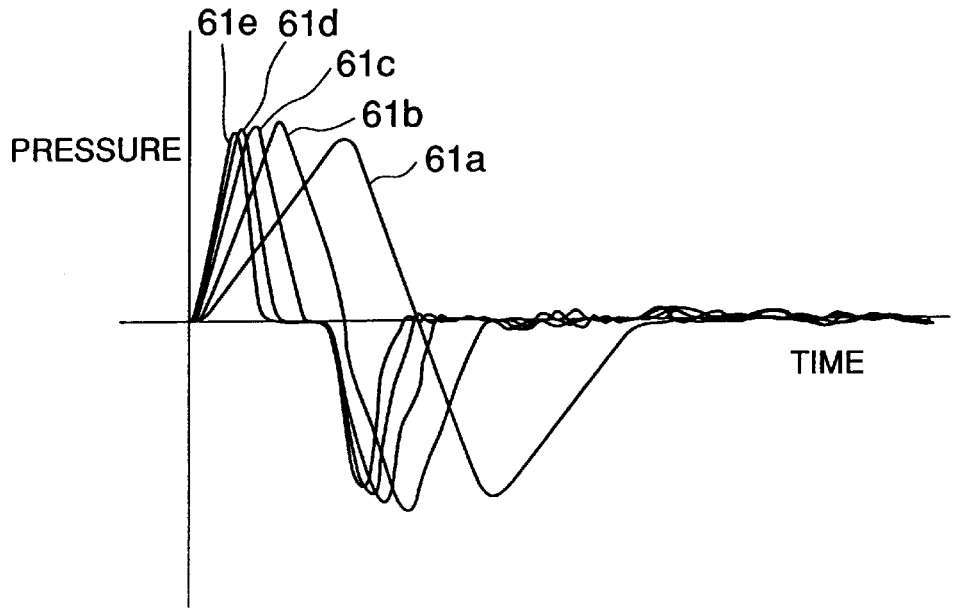
FIG. 9 shows the transient pressure response of ink in the ink-flow course of the ink jet recording head to the voltage, the form of which is shown in FIG. 8.

The rise time and fall time should be a half of a specific natural oscillation mode (Tn/2) to be excited, the same as that of the aforementioned embodiment. FIG. 9 shows the result of a computational simulation as to the pressure response 61*a* in the basic natural oscillation mode (the first-order mode) until the transient response of the pressure in the fifth-order mode. It is noted that the response curve 61*a* of the first-order mode is the result caused by the application of the voltage shown in FIG. 8.

In the second embodiment, as shown in FIG. 9, the wave length of pressure wave, namely, the amount of ink droplet can be changed by keeping the intensity of the pressure, namely, the speed of ejecting the ink droplet, constant, and also controlling the residual oscillation, by changing no more than the rise time and fall time (Tn/2) of the voltage wave form.

According to a computational simulation, the changes in the volume of ink droplet in the respective second-order until the fifth-order mode have been approximately 72%, 50%, 37%, and 30%, where we define the change in the volume of ink droplet in the first-order mode to be 100%.

Third Embodiment

Figure 10:
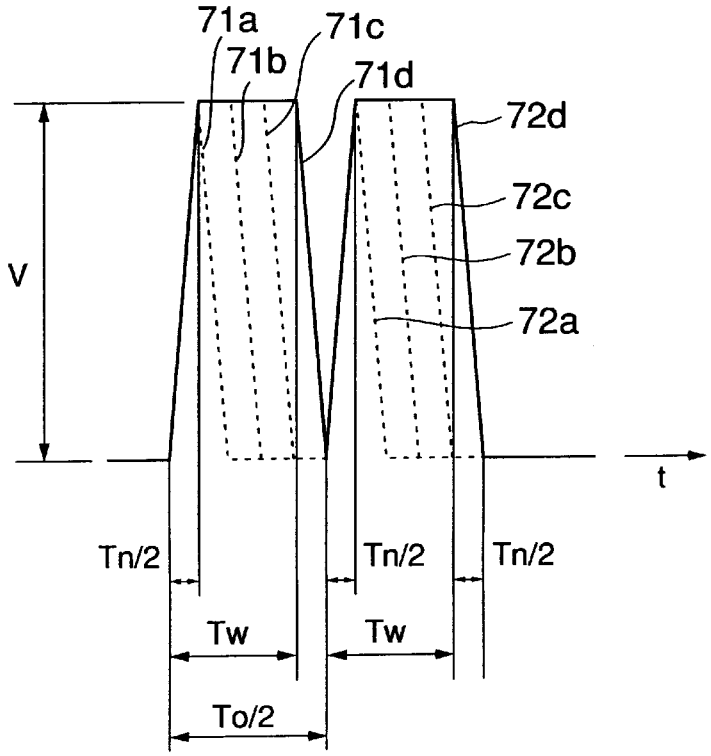
FIG. 10 shows a form of voltage applied to the ink jet recording head according to the present invention.

In a third embodiment, a voltage wave form shown in FIG. 10 will be explained. The voltage wave form in FIG. 10 is shaped as two trapezoids, contrary to the voltage wave form in FIG. 8 shaped as two triangles 51 and 52. According to the third embodiment where the trapezoids are utilized, as shown with reference numerals 71*a* to 71*d*, and 72*a* to 72*d* in FIG. 10, the voltage hold time (=Pulse width Tw) corresponding to the difference between the beginning of the rise time of the voltage wave form and the beginning of the fall time, is predetermined so that optional change is no more than the two pulse widths Tw enables fine change in the ink droplet to be ejected.

Figure 11:
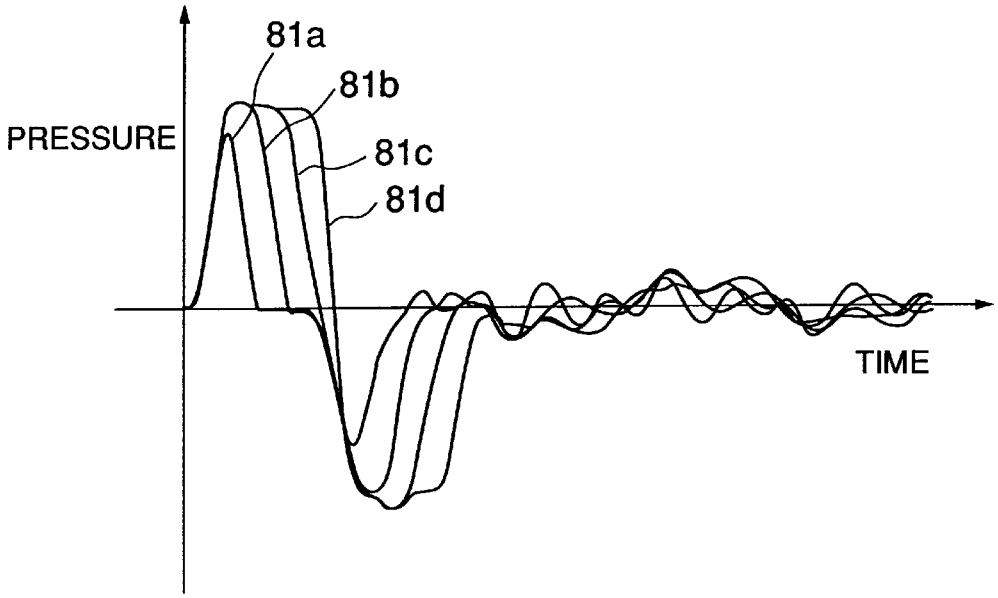
FIG. 11 shows the transient pressure response of the ink in the ink-flow course of the ink jet recording head, to the voltage, the form of which is shown in FIG. 9.

The result from a computational simulation as to the transient response of pressure is shown with reference numerals 81*a* to 81*d* in FIG. 11. Wherein, the rise time and fall time of voltage wave form (Tn/2) is determined in such a manner that: at first, a higher-order oscillation mode is selected, which can be used to eject the minimum diameter of ink droplet, namely the target diameter, (e.g., the fifth-order mode is selected in the embodiment shown in FIG. 11); secondly, with the natural period of oscillation mode as Tn, the rise time and fall time of the voltage wave form (Tn/2) is calculated. In the same manner as the above-mentioned procedure, with the natural period of the oscillation mode as Tn, the rise time and fall time of the voltage wave form are both set to Tn/2. Each phase difference between each adjacent voltage wave form from 71*a* to 71*d*, and 72*a* to 72*d* is set to a half of the natural period in the basic natural oscillation mode (To/2), in the same manner as the above-mentioned procedure. According to a computational simulation dependent upon these voltage wave forms, it has been learned that the amount of ink droplet can be changed, by keeping the speed of ejecting the ink droplet almost constant and also controlling the residual oscillation.

According to the results 81*a* to 81*d* from the calculation of an ink pressure response as shown in FIG. 11, when the pulse width Tw is changed into four widths; the maximum pulse width (To/2−Tn/2) (see 71*d* and 72*d* in FIG. 10); 75% of the maximum pulse width (see 71*c* and 72*c* in FIG. 10); 50% of it (71*b* and 72*b* in FIG. 10); and 25% of it where both the voltage wave forms are triangular, the changes in the volume of the ink droplet from the amount of ink droplet corresponding to the maximum pulse width are equal to 78%, 52%, and 26%, respectively. Accordingly, when the diameter of the ink droplet to be ejected in the basic oscillation mode is equal to 30 μm, the minimum diameter of the ink droplet possible to be ejected is equal to approximately 14 μm. Thus, by changing the pulse width Tw of the voltage wave forms 71 and 72, it is possible to provide multiple diameters of ink droplets ranging from 14 μm to 30 μm.

Fourth Embodiment

Next, a fourth embodiment will be described. According to the voltage wave forms shown in FIG. 12, at first, a negative voltage form of pulse is applied so that the capacity of the ink-flow course is increased, and then a positive voltage form of pulse is applied so that the capacity of the ink-flow course is reduced, resulting in ejecting of an ink droplet. The objective of this approach is to increase the speed of ejecting an ink droplet without giving the piezo-electric device 11 a high voltage, which may destroy its polarization.

To attain the objective, in such a manner as in the third embodiment, with the natural period of higher-order oscillation mode as Tn, at first, a backward voltage V2 is applied, which causes a smaller electric field than that where the piezo-electric device 11 starts inverting the polarization during the rise time (Tn/2), so that a negative pressure wave is generated. Thereafter, a given voltage V1 is reached during the rise time (Tn/2). The first voltages 91*a* to 91*d* with a given pulse width Tw are then applied during the rise time (Tn/2), after which the second voltages 93*a* to 93*d* with the phase To/2, the wave forms of which are the same as those of the first voltage. The pulse width Tw is changed within the range from Tn/2 to Tn so that a desired ink droplet can be obtained. For example, the pulse width Tw is changed into four widths: the maximum pulse width (To/2−Tn) (see the 91*d* and 93*d* in FIG. 12); 75% of the maximum pulse width (see 91*c* and 93*c* in FIG. 12), 50% of it (see 91*b* and 93*b* in FIG. 12), and 25% of it where both the voltages are of triangular wave forms 91*a* and 93*a*, pressure responses 94*a* to 94*d* when these voltages are applied, are shown in FIG. 13.

Figure 12:
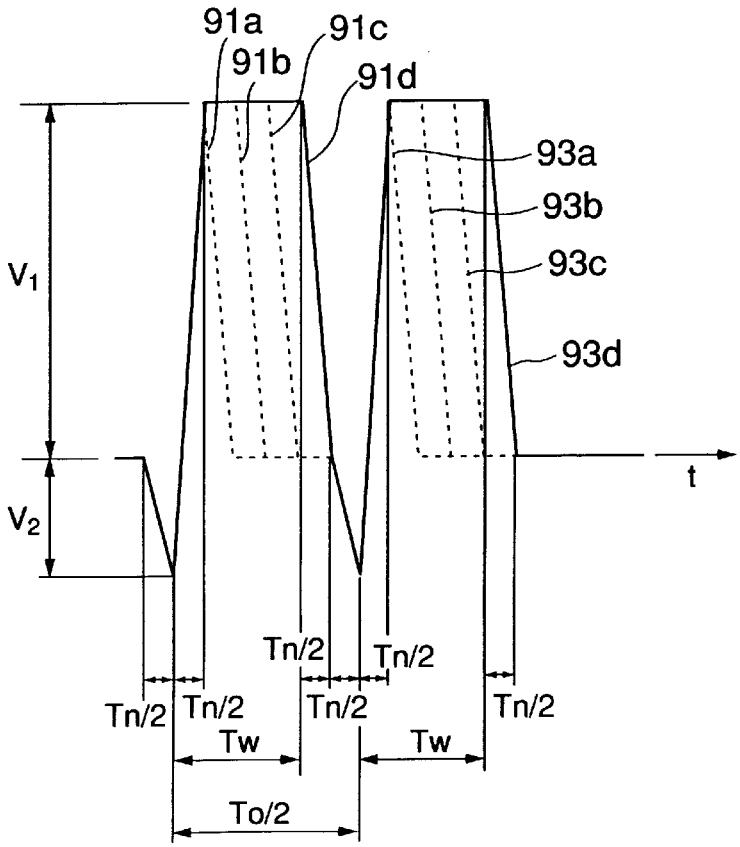
FIG. 12 shows another form of voltage applied to the ink jet recording head according to the embodiment of the present invention.
Figure 13:
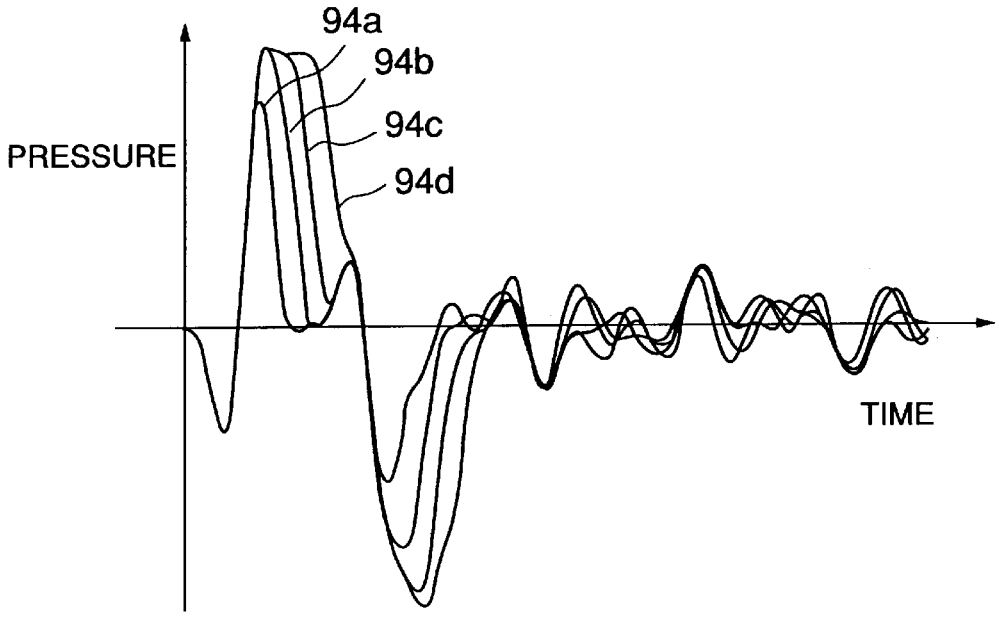
FIG. 13 shows the transient pressure response of the ink in the ink-flow course of the ink jet recording head, to the voltage, the form of which is shown in FIG. 12.

The changes in the amount of ink droplet with conditions shown in the figure, are 75% (see the pressure wave form 91*c* in FIG. 12), 51% (see the pressure wave form 91*b* in FIG. 12), and 27% (see 91*a* in FIG. 12), with the maximum diameter as 100% (see the pressure wave form 91*d* in FIG. 12). The changes in the amount of ink droplet are managed almost exactly.

Figure 14:
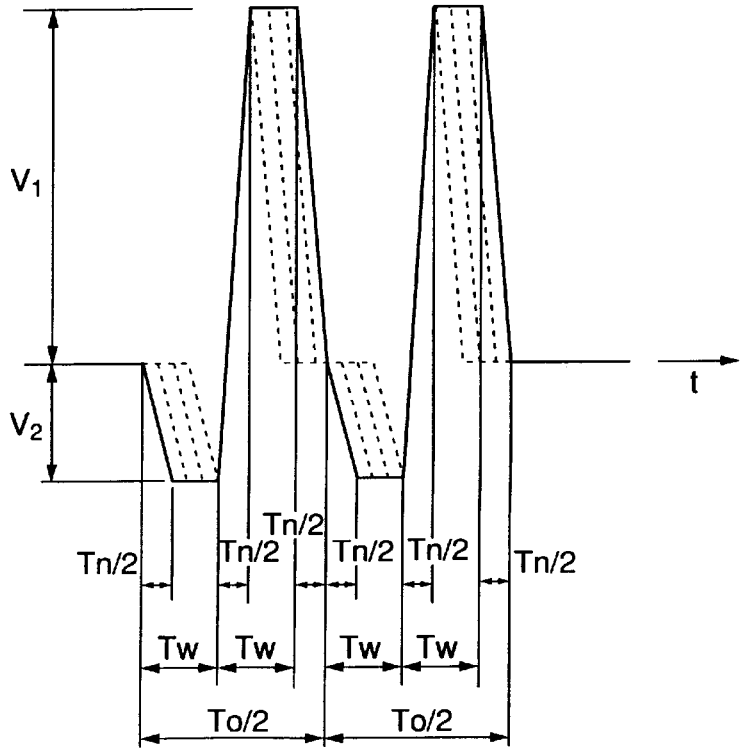
FIG. 14 shows another form of voltage applied to the ink jet recording head according to the embodiment of the present invention.

Up to this point, several embodiments have been explained. However, it is apparent that the present invention is not limited to them. For example, as shown in FIG. 14, even though the pulse width Tw of the negative voltage V2 and the pulse width Tw of the positive voltage V1 are changed together, a similar result to that described above can be obtained when an ink droplet is ejected.

Figure 15:
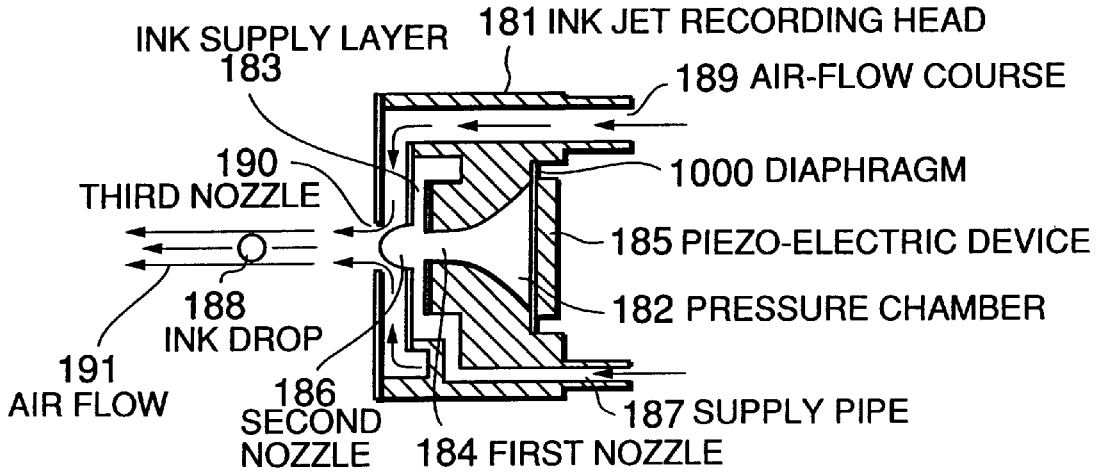
FIG. 15 shows the cross section of the conventional ink jet recording head.
Figure 16:
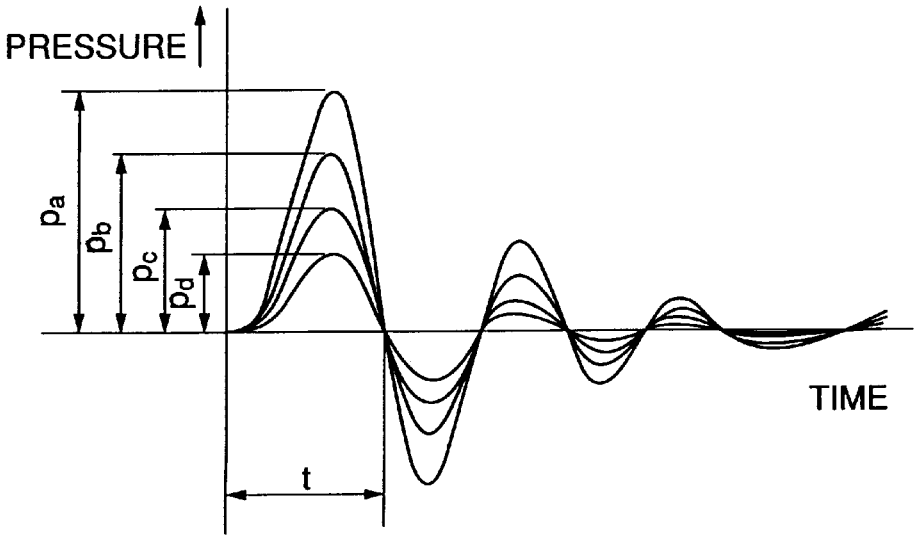
FIG. 16 shows a pressure response when the diameter of the ink droplet is controlled by the ink jet recording head shown in FIG. 15.
Figure 17A:
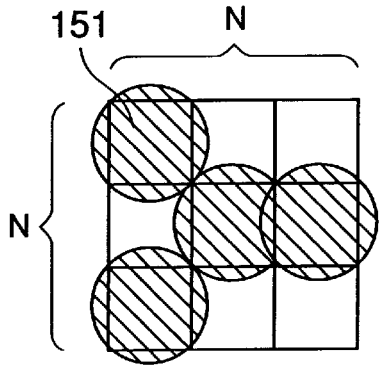
FIGS. 17A and 17B both show the dot pattern to display a half tone when the dot's diameter is invariable, and the dot pattern to display a half tone when the dot's diameter is variable.
Figure 17B:
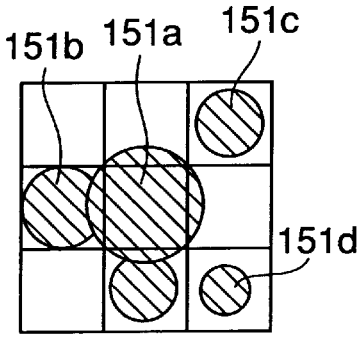
Figure 18:
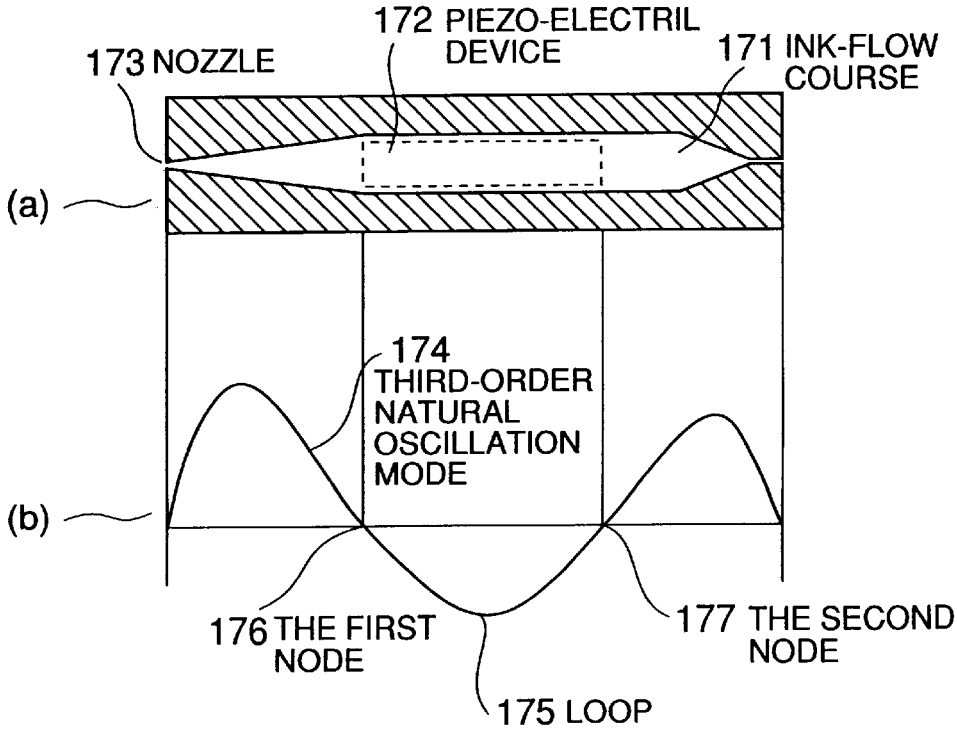
FIG. 18 shows both an upper surface cross section of another conventional ink jet recording head (a), and the third-order mode (b), corresponding to the natural oscillation mode of a pressurized wave generated in the ink-flow course of the ink jet recording head shown in (a).

The embodiments of the present invention are not limited to the ink jet recording head shown in FIG. 1, and can be applied to other types of ink jet recording heads with the other configurations such as those shown in FIGS. 15 and 18. Thus, it is apparent that the description of the aforementioned embodiments does not mean to limit the scope and spirit of the present invention.

As is described earlier, according to the present invention, the diameter of an ink droplet can be optionally changed without changing the speed of ejecting an ink droplet, and without any restriction on the size of the piezo-electric device, allowing recording of an image of high quality.

What is claimed is:

1. A drive apparatus of an ink jet recording head which includes at least one ink-flow course system, comprised of a nozzle and a pressure generation chamber, and also connected to an ink pool, and which deforms an electro-mechanical transducer to eject an ink droplet from the nozzle during a recording time by applying a drive voltage to the electro-mechanical transducer located at the position corresponding to the pressure generation chamber, comprising:

a hold circuit for holding a voltage applied to said electro-mechanical transducer;

a charge circuit for increasing said voltage from the basic value up to the peak value in a rise time, a discharge circuit for decreasing said voltage from the peak value down to the basic value in a fall time;

a control circuit for controlling said charge circuit and discharge circuit to form a voltage wave form for driving said electro-mechanical transducer, in accordance with a natural period of a harmonic wave of an order number to be oscillated in ink deposited in the ink-flow course system, wherein said control circuit comprises:

means for determining an order number of said harmonic wave to be oscillated in said ink-flow course system; and means for setting said rise time and fall time both approximately equal to a half of a natural period of a harmonic wave of said order number.

2. The ink jet recording head drive apparatus according to claim 1, wherein said control circuit controls said charge circuit and discharge circuit so that said rise time and said fall time are both equal to approximately a half of the natural period of the basic natural oscillation mode in the acoustic oscillation of ink in said ink-flow course system, whereas the time from the beginning of the rise time to the beginning of the fall time is equal to an integral multiple of the natural period.

3. The ink jet recording head drive apparatus according to claim 1, wherein the control circuit controls said charge circuit and discharge circuit so as to form the wave form comprising:

a triangular-shaped first voltage wave form, in which said rise time and said fall time are both equal to approximately a half of the natural period of a higher-order natural oscillation mode than the basic natural oscillation mode in the acoustic oscillation of an ink in the ink-flow course system; and a second voltage wave form with the same shape as the first voltage wave form is formed, whereas a time range from the beginning of the rise time in the first voltage wave form to the beginning of the rise time in the second voltage wave form, is equal to a half of the natural period of the basic natural oscillation mode.

4. The ink jet recording head drive apparatus according to claim 3, wherein said control circuit controls said charge circuit and discharge circuit to form a voltage form, the rise time and fall time of which are both equal to a half of the period of a higher-order natural oscillation mode, and therewith a desired minimum diameter of liquid is ejected.

5. The ink jet recording head drive apparatus according to claim 1, wherein said control circuit controls said charge circuit and discharge circuit so as to form a voltage wave form comprising:

a first voltage wave form, in which the rise time and the fall time are both equal to approximately a half of the natural period of a higher-order natural oscillation mode than the basic natural oscillation mode in the acoustic oscillation of ink in the ink-flow course system; and a second voltage wave form with the same shape as the first voltage wave form, whereas the time range from the beginning of the rise time in the first voltage wave form to the beginning of the rise time in the second voltage wave form, is equal to a half of the natural period of the basic natural oscillation mode.

6. The ink jet recording head drive apparatus according to claim 5, wherein said control circuit controls said charge circuit and discharge circuit so as to form a voltage wave form, in which the time range from the beginning of the rise time to the beginning of the fall time, is equal to a half of the natural period of the basic natural oscillation mode.

7. The ink jet recording head drive apparatus according to claim 5, wherein said control circuit controls said charge circuit and discharge circuit so as to form a voltage wave form, the voltage of which falls once and then rises, before the ascension of the voltage dependent upon the first and second voltage wave forms.

8. The ink jet recording head drive apparatus according to claim 5, wherein said control circuit controls said charge circuit and discharge circuit so as to form a voltage wave form, in which:

a backward voltage dependent upon the first and second voltage wave forms comes first so that an electric field smaller than that where a polarization begins to be inverted is generated;

the voltage ascends up to the peak value; and the voltage descends down to the basic value, wherein the fall time ranging from the basic value to the backward voltage, and the rise time ranging from the backward voltage to the peak value are both equal to approximately a half of the natural period of the natural oscillation mode selected.

9. The ink jet recording head drive apparatus according to claim 8, wherein said control circuit controls said charge circuit and discharge circuit so as to form a voltage wave form in which the time period ranging from the beginning of the fall time where the voltage descends from the basic value, to the beginning of the rise time where the voltage ascends from the backward voltage, is equal to approximately a half of the natural period of the natural oscillation mode selected.

10. An ink jet recording head drive method of allowing a nozzle to eject an ink droplet during a recording time by applying a drive voltage and thereby deforming an electro-mechanical transducer, where the electro-mechanical transducer is located at the location corresponding to a pressure generation chamber, and at least one ink-flow course system comprised of the nozzle and the pressure generation chamber is connected to an ink pool; wherein the drive method comprises the steps of:

generating a drive voltage with a voltage wave form corresponding to a natural period of a harmonic wave of an order number to be oscillated in ink in the ink-flow course system; and applying the drive voltage generated to the electro-mechanical transducer, wherein said step of generating a drive voltage comprises the steps of:

determining an order number of a harmonic wave to be oscillated in said ink-flow course system; and increasing said drive voltage in a rise time defined as a time from a basic value to a peak value, and decreasing said drive voltage in a fall time defined as a time from said peak value to said basic value, in a time approximately equal to a half of a natural period of a harmonic wave of said order number.

11. The ink jet recording head drive method according to claim 10, wherein the step of generating the drive voltage comprises the step of:

controlling the time range from the beginning of the rise time to the beginning of the fall time to be an integral multiple of the natural period including.

12. The ink jet recording head drive method according to claim 10, wherein the step of generating the drive voltage comprises the steps of:

generating a triangular-shaped first voltage wave form, in which the rise time range from the basic value in the voltage wave form to the peak value, and the fall time range from the peak value to the basic value are both equal to approximately a half of a higher-order natural oscillation mode of a basic natural oscillation mode of the acoustic oscillation of the ink in the ink-flow system; and generating a second voltage wave form which is the same as the first voltage wave form;

wherein, the time range from the beginning of the rise time in the first voltage wave form to the beginning of the rise time in the second voltage wave form, is equal to a half of the natural period of the basic natural oscillation mode.

13. The ink jet recording head drive method according to claim 12, wherein the step of generating the drive voltage further comprises the step of controlling both the rise time and the fall time to be a half period of the higher-order oscillation mode so that a desired minimum diameter of a liquid droplet is ejected.

14. The ink jet recording head drive method according to claim 10, wherein the step of generating the drive voltage further comprises the steps of:

generating a first voltage wave form, in which the rise time range from the basic value in the voltage wave form to the peak value, and the fall time range from the peak value to the basic value are both equal to approximately a half of a higher-order natural oscillation mode than the basic natural oscillation mode of the acoustic oscillation in the ink in the ink-flow system; and generating a second voltage wave form which is the same as the first voltage wave form;

wherein, the time range from the beginning of the rise time in the first voltage wave form to the beginning of the rise time in the second voltage wave form, is equal to a half of the natural period of the basic natural oscillation mode.

15. The ink jet recording head drive method according to claim 14, wherein both the steps of generating the first voltage wave form and generating the second voltage wave form comprises a step of controlling the time range from the beginning of the rise time to the beginning of the fall time to be integer-times the value which is approximately a half of the natural period of the higher-order natural oscillation mode.

16. The ink jet recording head drive method according to claim 14, wherein both the steps of generating the first voltage wave form and generating the second voltage wave form comprises the step of:

decreasing the voltage once; and increasing the voltage before increasing the voltage of the first and second voltages forms.

17. The ink jet recording head drive method according to claim 14, wherein both the steps of generating the first voltage wave form and generating the second voltage wave form comprises the steps of:

applying a backward voltage of the first and second voltage wave forms so that an electric field is generated which is smaller than that where a polarization begins to be inverted;

increasing the voltage up to the peak value after the backward voltage has been applied; and decreasing the voltage down to the basic value after the voltage has been increased up to the peak value, wherein, the fall time range from the basic value to the backward voltage, and the rise time range from the backward voltage to the peak value are both set to approximately a half of the natural period of the natural oscillation mode selected.

18. The ink jet recording head drive method according to claim 17, wherein both the steps of generating the first voltage wave form and generating the second voltage wave form further comprises the step of setting the time range from the beginning of the fall time where the voltage descends down to the basic value, to the beginning of the rise time where the voltage ascends from the backward voltage, to approximately a half of the natural period of the natural oscillation mode selected.

* * * * *